US010422181B2

(12) United States Patent
Leavitt

(10) Patent No.: US 10,422,181 B2
(45) Date of Patent: Sep. 24, 2019

(54) EXTENDIBLE BARRICADE

(71) Applicant: Donald Leavitt, Wrentham, MA (US)

(72) Inventor: Donald Leavitt, Wrentham, MA (US)

( * ) Notice: Subject to any disclaimer, the term of this patent is extended or adjusted under 35 U.S.C. 154(b) by 217 days.

(21) Appl. No.: 15/674,241

(22) Filed: Aug. 10, 2017

(65) Prior Publication Data

US 2017/0335623 A1 Nov. 23, 2017

Related U.S. Application Data

(62) Division of application No. 14/844,495, filed on Sep. 3, 2015, now Pat. No. 9,759,011.

(60) Provisional application No. 62/045,167, filed on Sep. 3, 2014.

(51) Int. Cl.
*E06B 9/52* (2006.01)
*E06B 9/04* (2006.01)

(52) U.S. Cl.
CPC ..... *E06B 9/522* (2013.01); *E06B 9/04* (2013.01); *E06B 2009/527* (2013.01)

(58) Field of Classification Search
CPC ..... E06B 9/522; E06B 9/52; E06B 2009/527; E06B 3/485; E06B 2009/002; E05D 15/24; E05Y 2900/106
See application file for complete search history.

(56) References Cited

U.S. PATENT DOCUMENTS 1,648,851 A 11/1927 Lapin
2,511,372 A 6/1950 Price
3,000,063 A 9/1961 Lawrence
3,380,429 A 4/1968 Moinicken et al.
3,622,125 A 11/1971 Powell
3,654,730 A 4/1972 Fraleigh
3,938,577 A * 2/1976 Richards ..... E06B 9/02 160/90
3,957,251 A 5/1976 McCracken
4,378,043 A 3/1983 Sorenson
4,495,979 A 1/1985 Schwob
4,653,566 A 3/1987 Miele
4,676,293 A 6/1987 Hanssen
(Continued)

FOREIGN PATENT DOCUMENTS

DE 2253126 A1 5/1974
FR 2178237 A1 11/1973

OTHER PUBLICATIONS

Restriction Requirement for U.S. Appl. No. 14/844,495, filed Sep. 3, 2015, dated Oct. 20, 2016.
(Continued)

*Primary Examiner* — Justin B Rephann
(74) *Attorney, Agent, or Firm* — Schmeiser, Olsen & Watts, LLP

(57) ABSTRACT

An attachment assembly is provided for coupling a portable barricade to an overhead door, including a clamp, the clamp having a first surface and a second surface, the second surface facing the overhead door, a fastener passing through a clamp opening of the clamp and through an opening of the overhead door, a coupling member operably engaged with the fastener, and a biasing element positioned between the second surface of the clamp and the overhead door, wherein, when the coupling member is actuated in a first direction, the biasing element is compressed, shortening a distance between the clamp and the overhead door.

20 Claims, 7 Drawing Sheets

(56) References Cited

U.S. PATENT DOCUMENTS

| | | | | |
|---|---|---|---|---|
| 4,770,087 | A | 9/1988 | Danley | |
| 4,787,174 | A | 11/1988 | Brown | |
| 5,407,178 | A | 4/1995 | Long | |
| 5,408,789 | A * | 4/1995 | Plfeger | B65G 69/2876 160/113 |
| 5,437,115 | A | 8/1995 | Freese | |
| 5,570,543 | A | 11/1996 | Bishop | |
| 5,584,333 | A | 12/1996 | Torchetti | |
| 5,611,382 | A | 3/1997 | Sferra | |
| 5,860,465 | A | 1/1999 | Eastridge | |
| 5,904,199 | A | 5/1999 | Messner | |
| 6,092,580 | A | 7/2000 | Lucas | |
| 6,315,027 | B1 * | 11/2001 | Lichy | E05D 15/165 16/271 |
| 6,415,844 | B1 | 7/2002 | Smith | |
| 6,557,614 | B1 | 5/2003 | Lampers | |
| 6,807,999 | B1 | 10/2004 | Bowen et al. | |
| 7,143,803 | B2 | 12/2006 | Mitchell | |
| 7,509,990 | B1 | 3/2009 | Milligan | |
| 7,841,269 | B1 | 11/2010 | Jacobs | |
| 8,991,470 | B1 | 3/2015 | Pacheco | |
| 2004/0020607 | A1 | 2/2004 | Aguirre, Jr. et al. | |
| 2004/0188664 | A1 | 9/2004 | Perelli et al. | |
| 2011/0227015 | A1 | 9/2011 | Perryman | |
| 2014/0311037 | A1 | 10/2014 | Russo | |
| 2014/0311039 | A1 | 10/2014 | Ardaiz | |

OTHER PUBLICATIONS

Office Action for U.S. Appl. No. 14/844,495, filed Sep. 3, 2015, dated Dec. 7, 2016.

Notice of Allowance for U.S. Appl. No. 14/844,495, filed Sep. 3, 2015, dated May 5, 2017.

* cited by examiner

EXTENDIBLE BARRICADE

CROSS-REFERENCE TO RELATED APPLICATIONS

This application is a non-provisional application that claims priority to U.S. application Ser. No. 14/844,495, filed Sep. 3, 2015, and entitled "Extendible Barricade," which claims priority to U.S. Provisional No. 62/045,167, filed Sep. 3, 2014, entitled "Extendible Barricade." The entire contents of U.S. application Ser. No. 14/844,495 and U.S. Provisional No. 62/045,167, filed Sep. 3, 2014 are hereby incorporated by reference.

FIELD OF TECHNOLOGY

The following relates to embodiment of a barricade and more specifically to embodiments of an extendible, portable barricade that can be used as an accessory to an overhead door.

BACKGROUND

Most garages and similar structures include an overhead door. Overhead doors can be opened and closed to provide access in and out of the garage. Overhead doors are often left opened to increase visibility and air flow, and to allow natural light to enter a garage while a person is working inside. However, when the overhead door is in an open position, debris, sticks, leaves, dirt particles, insects, and rodents may easily enter the garage, which causes unwanted problems. To prevent this from happening, the overhead door must be fully closed. Unfortunately, when the overhead door is fully closed, a person inside must deal with limited natural light and air flow, the necessity to open and close the overhead door each time the person exits and reenters, and reduced or significantly limited visibility to areas outside of the garage.

Thus, a need exists for an apparatus and method for a barricade that can prevent entry of unwanted objects and animals, yet allow a person to enjoy the advantages of an overhead door being in an open position.

SUMMARY

A first aspect relates generally to an apparatus comprising a housing having an interior volume, a first panel located within the interior volume of the housing that is extendable from the housing, and a second panel located within the interior volume of the housing that is extendible from the housing, wherein the housing is releasably attached to an overhead door.

A second aspect relates generally to an attachment assembly for coupling a portable barricade to an overhead door, comprising a clamp, the clamp having a first surface and a second surface, the second surface facing the overhead door, a fastener passing through a clamp opening of the clamp and through an opening of the overhead door, a coupling member operably engaged with the fastener, and a biasing element positioned between the second surface of the clamp and the overhead door, wherein, when the coupling member is actuated in a first direction, the biasing element is compressed, shortening a distance between the clamp and the overhead door such that a portion of the portable barricade located behind the clamp is urged toward the overhead door.

A third aspect relates generally to a method of providing a temporary barrier across an entrance, comprising releasably securing a barricade to an inside surface of an overhead door of a structure having the entrance, wherein when the overhead door is in a closed position, releasing the barricade, and extending one or more side panels across the entrance to form the barrier.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figures 1A, 1B:
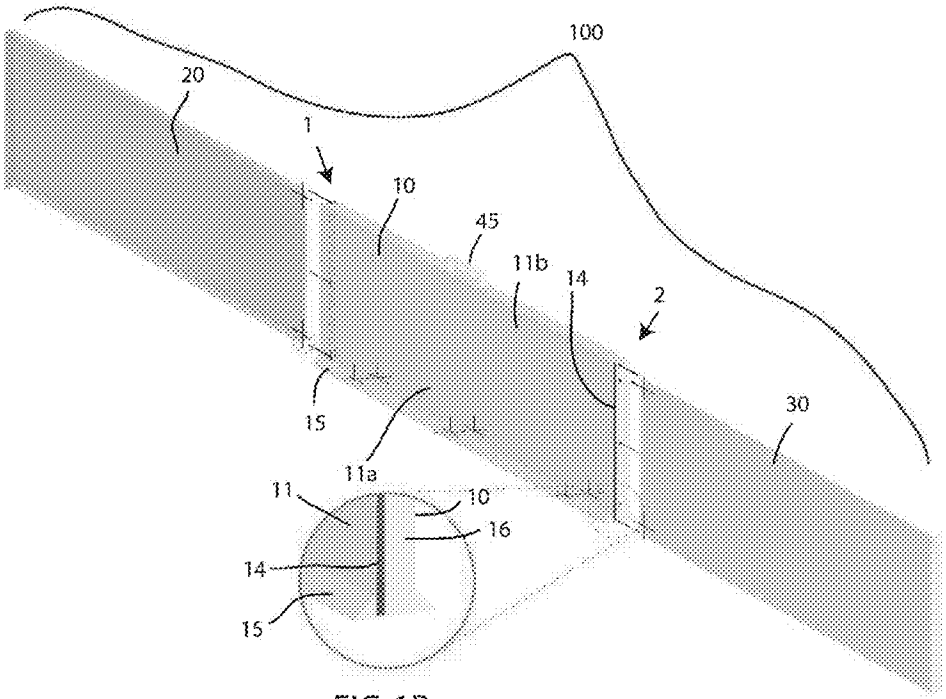
FIG. 1A depicts a perspective, assembly view of an embodiment of a barricade.
FIG. 1B depicts a detailed view of FIG. 1A.

Referring to the drawings, FIG. 1A depicts an embodiment of a barricade 100. Embodiments of a barricade 100 may be a complete or partial barricade. For example, embodiments of the barricade 100 need not completely restrict access to a location. Embodiments of barricade 100 may be a wall, an obstacle, a barrier, a partial barrier, a panel, a divider, a gate, and the like. Embodiments of barricade 100 may be used to provide a barrier or partial barrier at, proximate, or otherwise near an entrance to a structure. Embodiments of the structure may be a garage or similar building or dwelling that has an opening or access point. Embodiments of barricade 100 may be used in conjunction with an overhead door, such as garage door, that can be a part of the structure. For example, embodiments of the barricade 100 may be temporarily attached to an overhead door such that the barricade 100 moves with the overhead door as the overhead door moves. Overhead doors may move (manually or automatically) from an open position to a closed position. When in a closed position, entry or access is prevented or hindered, typically abutted against or resting on or very near a ground surface. When in open position, the overhead door may be a distance away from the ground surface, which may allow access or entry of various objects, including, debris, people, animals, rodents, yard waste, etc. Overhead days may be partially open or partially closed. Accordingly, embodiments of the barricade 100 may be coupled to the overhead door of a structure, as described in greater detail infra.

Moreover, embodiments of the barricade 100 may be portable, wherein a user may relocate the barricade 100 with relative ease, and place in any location where a barricade, a barrier, or obstacle is desired. For example, embodiments of barricade 100 may include a handle portion 45 for gripping, lifting, grabbing, etc. the barricade 100 for moving, relocating, placing, carrying, etc. the barricade 100. Thus, embodiments of the barricade 100 may be manually placed at or near an entrance to a structure or other designated space, or it may be displaced by the opening and closing of the overhead door if the barricade 100 is operably attached to the overhead door. Furthermore, embodiments of the barricade 100 may be extendible, adjustable, configurable, etc., to accommodate various widths or sizes of openings. Because the barricade 100 may be extendible, the size or lateral reach of the barricade 100 may be adjusted by a user to either accommodate a fixed opening such that it extends from one end of the opening to the other, or to allow the user to determine a total length or width of the barrier formed by the barricade 100. Further embodiments of the barricade 100 may include a strip of reflector tape or material so that it can be visible during the night when headlights or other lights are directed at the barricade 100 to warn or alert others to its presence in the entrance. Likewise, the strip may also be non-reflective, but of a bright conspicuous color to notify others of its presence during the day.

Referring now to FIGS. 1A-3, embodiments of a barricade may include a housing 10, a first panel 20, and a second panel 30. Embodiments of the barricade 100 may include a housing 10, a first panel 20 located within the housing 10, and second panel 30 also located within the housing, wherein the first panel 10 and the second panel 30 may be independently extendible from a first end 1 and a second 2 of the housing 10, respectively.

Embodiments of the barricade 100 may include a housing 10. Embodiments of the housing 10 may be a central housing, a central unit, a central panel, a covering, a receptacle, and the like. Embodiments of the housing 10 may have a first end 1, a second end 2, a first section 11*a* having an exterior first surface 11*b*, and a second section 12*a* having an exterior surface second surface 12*b*. The first surface 11*b* and the second surface 12*b* may be a continuous, solid surface forming a wall, barrier, obstacle, barricade, and the like. Alternatively, the first surface 11*b* and/or second surface 12*b* may include a plurality of openings or slits to allow passage of air, but restrict or prevent solids or other debris. Moreover, the first section 11*a* and the second section 12*a* may be spaced apart a distance to form an interior volume or space 19. Embodiments of the interior volume 19 of the housing 10 may be the space, gap, void, and the like, formed by a bottom and top portion of the housing 10 that can be connected to the first section 11*a* and the second section 12*a*. For example, embodiments of the housing 10 may include an interior volume 19 to completely or partially accommodate, house, retain, receive, store, etc. the first panel 20 and the second panel 30 when the barricade 100 is in a first position (e.g. non-extended position) and a second position (e.g. extended or partially extended position). The size of the interior volume 19 may vary, and may depend on the size of the housing 10, and/or the distance between the first section 11*a* and the second section 12*b*. In some embodiments, the distance between the first and second panel sections of the housing 10 may be 2 inches, which accommodates a first panel 20 and a second panel 30, wherein a thickness of the first panel 20 and a second panel 30 is ¼ inch. Those skilled in the art can appreciate that the housing 10, the first panel 20, and the second panel 30 may be sized and dimensioned in any way that allows the first panel 20 and the second panel 30 to reside within the housing 10 (e.g. side-by side) and move independently while within the housing 10 to extend, at least laterally, a distance from the housing 10.

Figure 3:
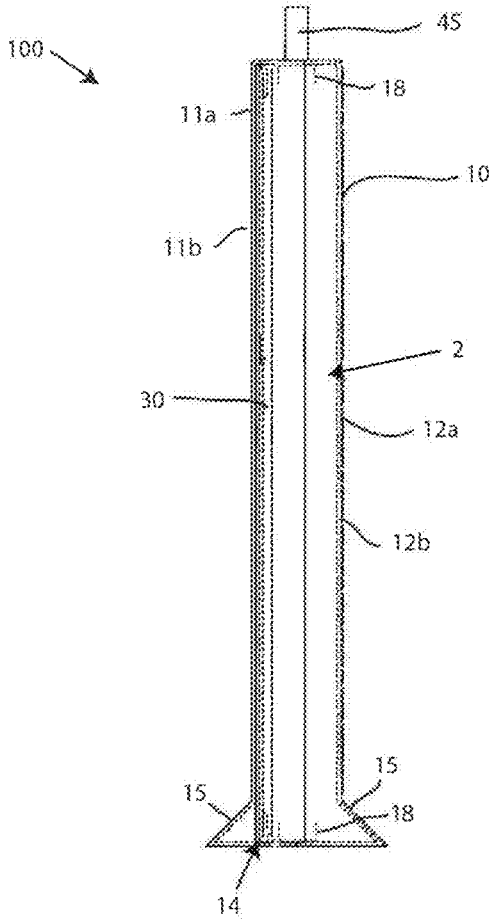
FIG. 3 depicts a side, cross-section view of an embodiment of the barricade.

Furthermore, embodiments of the housing 10 may include a guide element 18 to facilitate and guide the lateral movement of the first panel 20 and the second panel 30 from a first position to a second position. Embodiments of the guide element 18 may be one or more tracks, channels, guides, brackets, railings, and the like. For instance, the guide element 18 may include two side walls with an optional bottom portion (the bottom portion may be an inner surface of the housing) that can form a channel 14, as shown in FIGS. 1A and 3. Embodiments of channel 14 may be a path, a channel, a track, and the like, on either side of the guide element 18; the channel 14 may be vertical and or elongated to accommodate the size of the first and second panel 20, 30. In an exemplary embodiment, the guide element(s) 18 may be a C-shaped channel panel track. The space created between the first section 11*a* and a first side of the guide element 18 may form the channel 14, wherein the channel 14 may extend from a bottom portion of the housing 10 to a top portion of the housing 10. For instance, the guide element 18 may be located at, proximate, or otherwise near a center location between the first section 11*a* and the second section 12*a* of the housing 10, along or attached to a bottom portion and/or a top portion of the inner surface of the housing 10 to form the channel 14, which can be a space or vertical slot on either side of the guide element 18 for movement of the first panel 20 and the second panel 30. The guide element(s) 18 may be placed proximate either the first end 1 or the second end 2 of the housing 10, or at any point between. In alternative embodiments, the first panel 20 and the second panel 30 may share the space formed between the two side walls of the guide element 18, or may share a space on either side of the two side walls of the guide element 18. In yet another embodiment, the guide element may include a single wall that may divide or split the interior volume 19 of the housing 10 into two areas, wherein one or both of the first panel 10 and the second panel 30 may reside in one of the divided areas. In further embodiments, the housing 10 may not include a guide element 18, and the movement of the first panel 20 and the second panel 30 may be guided and/or facilitated by inner walls of the housing 10. Embodiments of the guide element 18 may be a separate component that can be fastened, attached, or otherwise connected to the housing 10, or may be structurally integral with the housing 10.

Moreover, embodiments of the housing 10 may include a handle portion 45 located on the top surface of the housing for carrying, placing, transporting, or otherwise maneuvering the barricade 100. Embodiments of the handle portion 45 may be curvilinear, rectangular, and or square-shaped. Embodiments of the handle portion 45 may be connected to the housing 10 at one or more locations, and may include a padded section and/or ergonomic grips. There may be more than one handle portion 45 operably attached to the housing 10. Further, embodiments of the housing 10 may include a ramped portion 15. Embodiments of the ramped portion 15 may extend from the first end 1 to the second end 2 of the housing 10. The ramped portion 15 may include a ramped or otherwise inclined section that tapers from the first surface 11*b* and the second surface 12*b*, respectively, to form a footing or base for the housing 10. For example, embodiments of the ramped portion 15 may help prevent or may resist wobbling or toppling over of the barricade 100. Additionally, embodiments of the housing 10 and its components may be comprised of metal, lightweight metal, metal alloy, a rigid plastic, a composition, polymer, or a combination thereof. In exemplary embodiment, the materials forming the housing 10 can be lightweight, rigid materials, such as aluminum or polyvinyl chloride.

With continued reference to FIGS. 1A-3, embodiments of the barricade 100 may include a first panel 20. Embodiments of the first panel 20 may be a continuous, solid surface forming a wall, barrier, obstacle, barricade, and the like. Alternatively, the first panel 20 may include a plurality of openings or slits to allow passage of air, but restrict or prevent solids or other debris, such as a screen. Embodiments of the first panel 20 may be a panel, a section, a wall, a planar, three-dimensional object, and the like. Moreover, embodiments of the first panel 20 may be housed, accommodated, received, stored, etc. by the housing 10. For instance, embodiments of the first panel 20 may be located within the interior volume or space 19 of the housing. In an exemplary embodiment, the first panel 20 may be located within the channel 14 of the housing 10, which can be between the first section 11*a* and the guide element(s) 18. The first panel 20 may be slidable or otherwise extended from the first end 1 of the housing 10 to increase a width of the barricade 100. Specifically, embodiments of the first panel 20 may be pulled or otherwise laterally moved in a direction away from the first end 1 of the housing 10 to a desired distance, while traveling within the channel 14. The movement of the first panel 20 within the housing may be controlled, guided and/or limited by the guide element(s) 18 as determined by the size of channel 14. In addition, one or more rollers or tracks may be inserted within the housing 10 proximate the guide element 18 to facilitate the movement of the first panel 20.

Furthermore, embodiments of the first panel 20 may include a first lip 25 and a second lip 26 at, proximate, or otherwise near an end of the first panel 20. Embodiments of the first lip 25 and the second lip 26 may be a lip, a protrusion, a hook, or other mechanical structural feature that extends from the surface of the first panel 20. Embodiments of the first lip 25 may be configured to engage the housing 10 at the first end 1 of the housing 10 when closing or reinserting the first panel 20 into the housing 10. The first lip 25 may, upon engagement with the housing 10, prevent or hinder further movement within the housing 10 beyond the first end 1 of the housing 10. For instance, the mechanical interference between the housing 10 and the first lip 25 may preclude the first panel 20 from being difficult for a user to grip and extend the first panel 20. In addition, the first lip 25 may function as a gripping device for a user to grab and extend the first panel 20. Embodiments of the first panel 20 may also include a second lip 26. Embodiments of the second lip 26 may be slightly smaller than the first lip 25 with respect to the distance from the first panel 20, and may act as a spacer to facilitate easy gripping and maneuvering of the first panel 20. For instance, embodiments of the second lip 26 may first engage a portion of the housing 10 at the first end 1 of the housing 10 to prevent further movement of the first panel 20 within the housing 10 as described above. If the second lip 26 engages the housing 10, the distance between the second lip 26 and the first lip 25 may allow a user to easily grab the first lip 25 and extend the first panel 20. Further, embodiments of the first panel 20 may be comprised of metal, lightweight metal, metal alloy, a rigid plastic, a composition, a polymer, or a combination thereof. In exemplary embodiment, the materials forming the housing 10 can be lightweight, rigid materials. In addition, embodiments of the first panel 20 may include both rigid materials and non-rigid materials, such as a screen, mesh material.

Referring still to FIGS. 1A-3, embodiments of the barricade 100 may include a second panel 30. Embodiments of the second panel 30 may include the same or substantially the same structural and functional aspects of the first panel 10. For example, of the second panel 30 may be a continuous, solid surface forming a wall, barrier, obstacle, barricade, and the like. Alternatively, the second panel 30 may include a plurality of openings or slits to allow passage of air, but restrict or prevent solids or other debris. Embodiments of the second panel 30 may be a panel, a section, a wall, a planar, three-dimensional object, and the like. Moreover, embodiments of the second panel 30 may be housed, accommodated, received, stored, etc. by the housing 10. For instance, embodiments of the second panel 30 may be located within the interior volume or space 19 of the housing. In an exemplary embodiment, the second panel 30 may be located within a channel, similar to the channel 14, of the housing 10, which can be between the second section 12*a* and the guide element(s) 18. The second panel 30 may be slidable or otherwise extended from the second end 2 of the housing 10 to increase a width of the barricade 100. Specifically, embodiments of the second panel 30 may be pulled or otherwise laterally moved in a direction away from the second end 2 of the housing 10 to a desired distance, while traveling within the channel between the second section 12*a* of the housing and the guide element(s) 18. The movement of the second panel 30 within the housing may be controlled, guided and/or limited by the guide element(s) 18 as determined by the size of the channel. In addition, one or more rollers or tracks may be inserted within the housing 10 proximate the guide element 18 to facilitate the movement of the second panel 30.

Figure 2A:
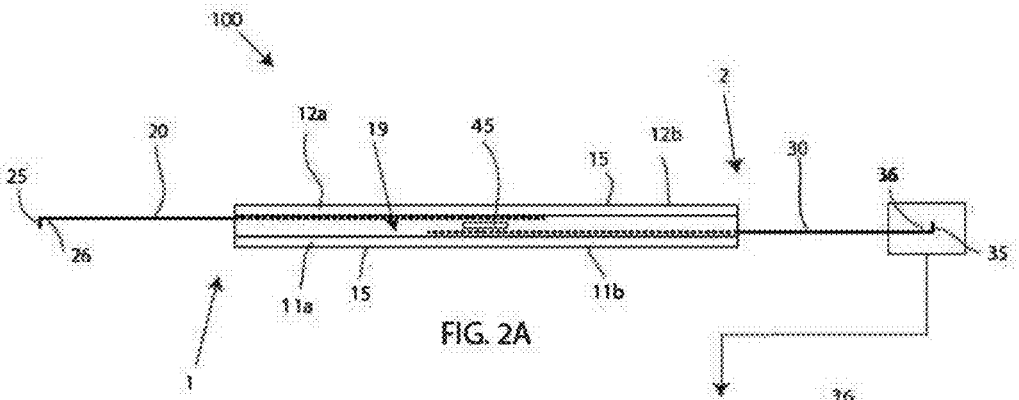
FIG. 2A depicts a top, cross-section view of an embodiment of the barricade.
Figure 2B:
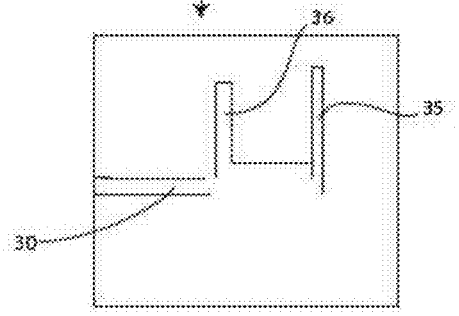
FIG. 2B depicts a detailed view of FIG. 2A.

Furthermore, as shown in FIG. 2B, embodiments of the second panel 30 may include a first lip 35 and a second lip 36 at, proximate, or otherwise near an end of the first second 30. Embodiments of the first lip 35 and the second lip 36 may be a lip, a protrusion, a hook, or other mechanical structural feature that extends from the surface of the second panel 30. Embodiments of the first lip 35 may be configured to engage the housing 10 at the second end 2 of the housing 10 when closing or reinserting the second panel 30 into the housing 10. The first lip 35 may, upon engagement with the housing 10, prevent or hinder further movement within the housing 10 beyond the second end 2 of the housing 10. For instance, the mechanical interference between the housing 10 and the first lip 35 may preclude the second panel 30 from being difficult for a user to grip and extend the second panel 30. In addition, the first lip 35 may function as a gripping device for a user to grab and extend the second panel 30. Embodiments of the second panel 30 may also include a second lip 36. Embodiments of the second lip 36 may be slightly smaller than the first lip 35 with respect to the distance from the second panel 30, and may act as a spacer to facilitate easy gripping and maneuvering of the second panel 30. For instance, embodiments of the second lip 36 may first engage a portion of the housing 10 at the second end 2 of the housing 10 to prevent further movement of the second panel 30 within the housing 10 as described above. If the second lip 36 engages the housing 10, the distance between the second lip 36 and the first lip 35 may allow a user to easily grab the first lip 35 and extend the second panel 30. Further, embodiments of the second panel 30 may be comprised of metal, lightweight metal, metal alloy, a rigid plastic, a composition, or a combination thereof. In exemplary embodiment, the materials forming the housing 10 can be lightweight, rigid materials. In addition, the second panel 30 may be comprised of both rigid and non-rigid materials.

Figure 4:
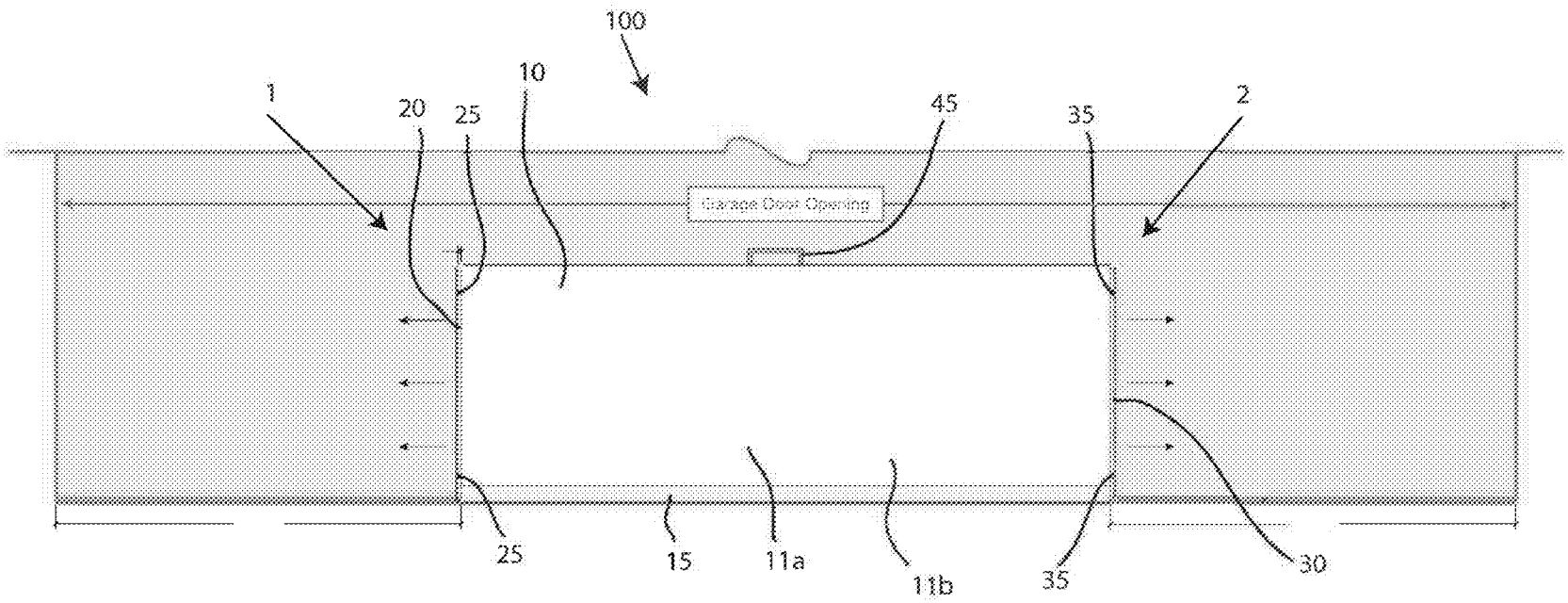
FIG. 4 depicts front view of an embodiment of the barricade in a first position.
Figure 5:
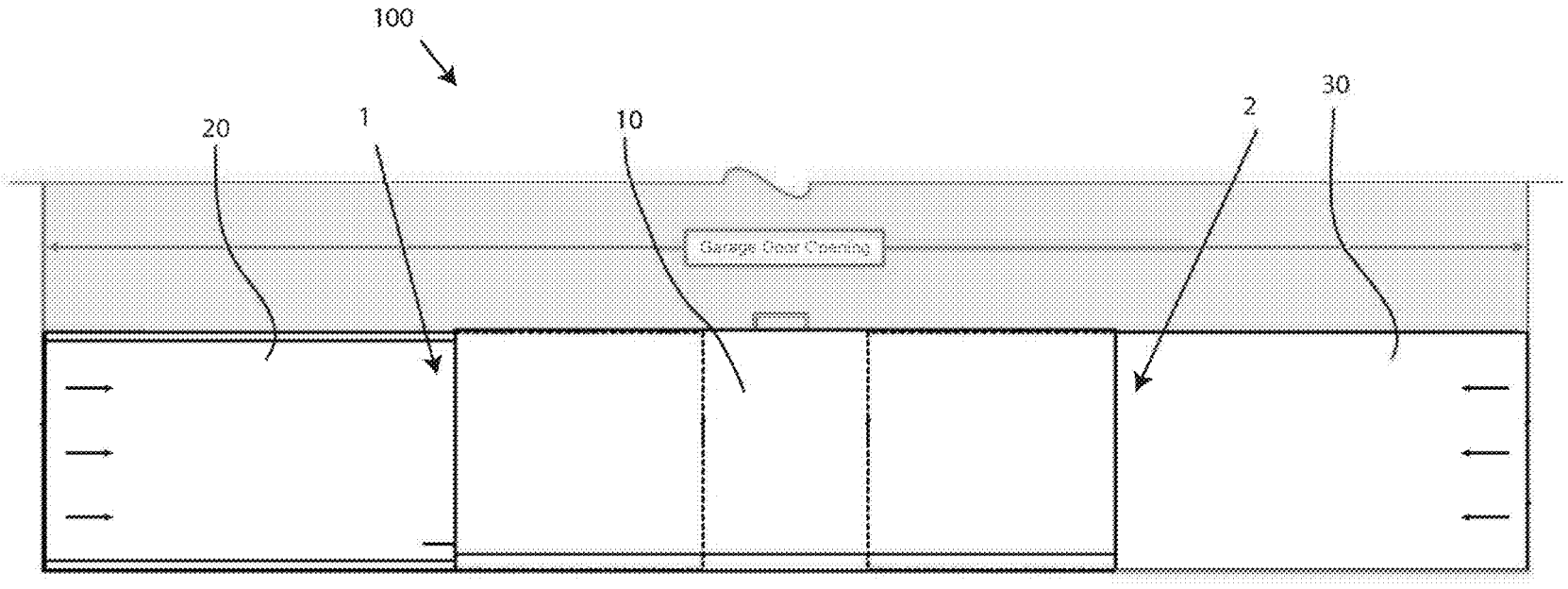
FIG. 5 depicts a front view of an embodiment of the barricade in a second position.

Continuing to refer to the drawings, FIGS. 4 and 5 depict embodiments of the barricade 100 in a first position and a second position. FIG. 4 depicts an embodiment of the barricade 100 in a first position. The first position may be a position where the first and second panels 20, 30 are located, either entirely or substantially entirely, within the housing 10. In other words, in the first position, the barricade 100 is in a non-extended position. In this position, the barricade 100 can still act as a barricade or barrier where it is placed. FIG. 5 depicts an embodiment of the barricade 100 in a second position. The second position may be where the first and second panels 20, 30 are at least partially extended from the barricade 100. For example, the first and second panels 20, 30 may be extended outwardly from the housing 10 to extend across an opening, such as an opening of a garage door. The side panels 20, 30 may be independently extended, such that one panel may be extended, while the other remains within the housing 100, or where both panels 20, 30 are extended an unequal distance. In both the first position and the second position, embodiments of the barricade 100 may prevent access or establish a barricade or barrier against environmental elements, debris, animals, insects, and other objects. In addition, if an overhead door of a structure is in an open position, air flow and natural light is allowed through, while still having a physical barrier for the above-mentioned objects.

Figure 6:
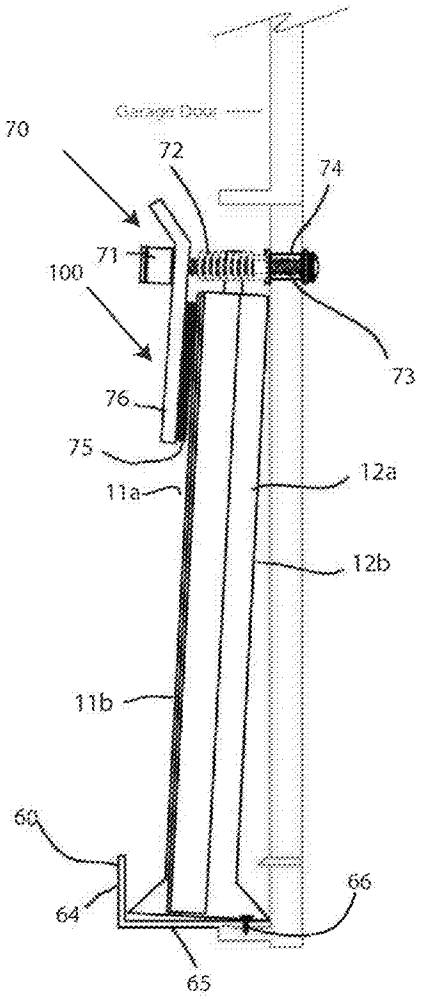
FIG. 6 depicts a side view of an embodiment of the barricade releasably attached to an overhead door by an embodiment of an attachment means.
Figure 7B:
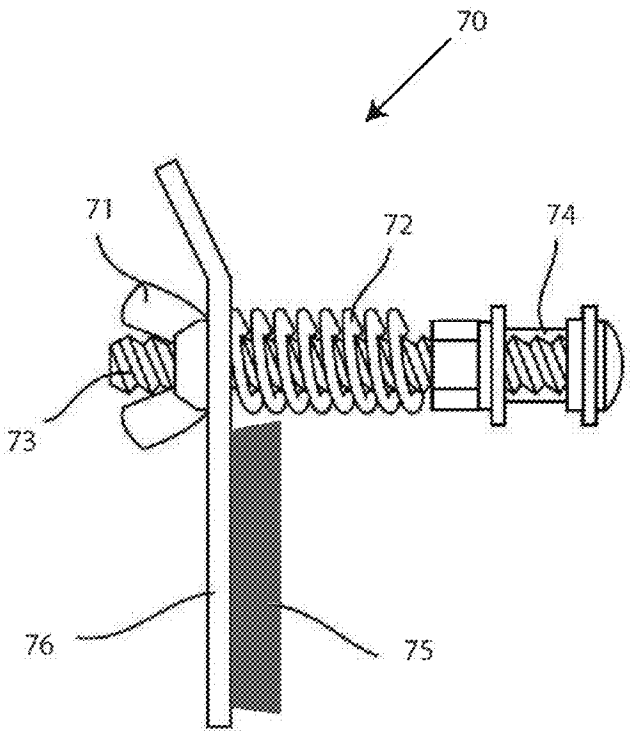
FIG. 7B depicts a side view of an embodiment of the attachment assembly.
Figure 7A:
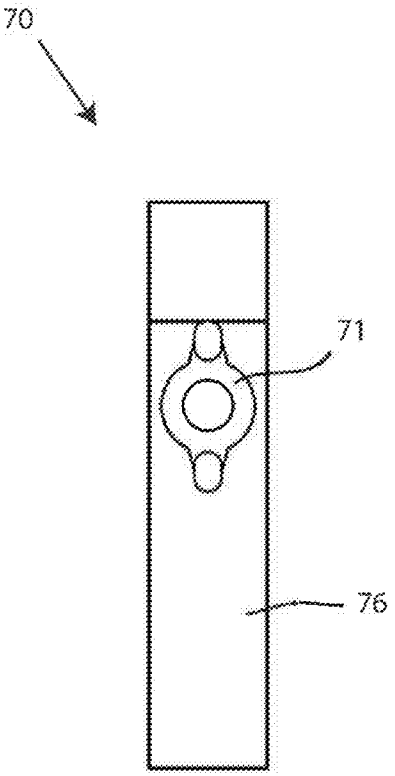
FIG. 7A depicts a front view of an embodiment of an attachment assembly.

Turning now to FIGS. 6-7B, embodiments of the barricade 100 may be coupled to an overhead door, such as a garage door. For example, embodiments of the housing 10 of the barricade 100 may be releasably attached to an inside surface of an overhead door, wherein the housing 10 may remain attached to the overhead door as it moves back and forth from an open position to a closed position. Because the barricade 100 may be releasably attached, affixed, fastened, coupled, etc. to the overhead door, such as a garage door, the user need not worry about the storage and placement of the barricade 100 when not needed. Further, when the overhead door is in a closed position, the user may simply release the barricade 100 from the overhead door, and it can be in placed in the proper spot for creating a barrier at the entrance of the structure.

Embodiments of the barricade 100 may be releasably attached to the overhead door by an attachment assembly 70. Embodiments of the attachment assembly 70 may releasably attach, couple, affix, fasten, etc. the housing 10 to an inside surface of an overhead door. Embodiments of the attachment assembly 70 may releasably secure the housing 10 to the overhead door, wherein tightening or loosening the attachment assembly 70 may secure or release the housing 10. Embodiments of the fastening assembly 70 may include a coupling member 71, a biasing element 72, a fastener 73, such as a bolt 73, an anchor 74, a clamp 76, and an elastic member 75. The fastener 73 may be a carriage bolt or similar bolt, and may be threaded, and may pass through a created opening in the overhead door. An anchor 74 or similar component may be placed within the opening in the overhead door to anchor or otherwise support the bolt 73 passing through the overhead door. A washer may be placed between the biasing element 72 and the inside surface of the overhead door. At the free end of the fastener 73 (i.e. opposite the head), a clamp having an opening corresponding to the diameter of the fastener 73 may be placed onto the fastener, after the biasing element is placed over to radially surround the bolt 73. Embodiments of the biasing element 72 may be a spring, such as a compression spring. The coupling element 71 may be placed over the free end to prevent unwanted disengagement of the biasing element 72 and the clamp portion 76 (and potentially a washer). When the coupling member 71 is rotated in a first direction, the biasing element 72 may be compressed, shortening the distance between the clamp portion 76 and the overhead door. Because a portion of the housing 10 can be located behind the clamp 76, when the clamp 76 is driven forward, the housing 10 is tightened against the inside surface of the overhead door. The tighter the housing 10 is against the overhead door, the more secure it is to the door, which can allow the housing 10 to remain attached to the door when the overhead door moves from a closed position to an open position. An elastic material 75 can be affixed to the clamp so as to prevent damage to the housing 10 when the attachment assembly 70 is tightened to a secure position.

Conversely, the coupling member 71 may be rotated in a second direction, opposite the first direction, to loosen the housing 10 from the overhead door. For instance, when the coupling member 71, such as a wing nut, is rotated in a second direction, the distance between the clamp 76 and the surface of the overhead door is increased, loosening the connection between the housing 10 and the overhead door. In the loosened position, the housing 10 may be removed from engagement with the attachment assembly 70, while the attachment assembly 70 remains intact and attached to the overhead door. Alternatively, the attachment assembly 70 may be removed when the housing 10 is removed from a releasably secure position. Additionally, a base plate 60 may be used in conjunction with the attachment assembly 70. Embodiments of the base plate 60 may help accommodate a weight of the housing 10 to facilitate the securing and releasing of the housing 10 to the overhead door. Embodiments of the base plate 60 may be releasable fastened to the overhead door with one or more fasteners 66. The base plate 60 may include a bottom portion 65 and a wall portion 64. Accordingly, embodiments of the barricade 100 may be releasably attached to an inside surface of an overhead door.

With reference now to FIGS. 1A-7B, a method of providing a temporary barrier across an entrance may include the steps of releasably securing a barricade 100 to an inside surface of an overhead door of a structure having the entrance, wherein when the overhead door is in a closed position, releasing the barricade 100, and extending one or more side panels 20, 30 across the entrance.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims.

The claims provide the scope of the coverage of the invention and should not be limited to the specific examples provided herein.

The invention claimed is:

1. An attachment assembly for coupling a portable barricade to an overhead door, comprising:

a clamp, the clamp having a first surface and a second surface, the second surface facing the overhead door;

a fastener passing through a clamp opening of the clamp and through an opening of the overhead door;

a coupling member operably engaged with the fastener;

a biasing element positioned between the second surface of the clamp and the overhead door;

wherein, when the coupling member is actuated in a first direction, the biasing element is compressed, shortening a distance between the clamp and the overhead door such that a portion of the portable barricade located behind the clamp is urged toward the overhead door.

2. The attachment assembly of claim 1, further comprising an anchor to receive the fastener within the opening of the overhead door.

3. The attachment assembly of claim 1, further comprising an elastic element located on the second surface of the clamp.

4. The attachment assembly of claim 1, wherein the portion of the portable barricade is urged toward the overhead door to secure the portable barricade against an inner surface of the overhead door.

5. The attachment assembly of claim 1, wherein the fastener is a threaded carriage bolt.

6. The attachment assembly of claim 1, wherein, when the coupling member is actuated in a second direction, a distance between the clamp and the overhead door is increased to release the portable barricade located behind the clamp from secure engagement with the overhead door.

7. The attachment assembly of claim 1, further comprising a base plate configured to operably engage the overhead door to accommodate a weight of the portable barricade.

8. A method for attaching a portable barricade to an overhead door, the method comprising:

providing a clamp having a first surface, a second surface, and an opening therethrough, and a fastener configured to extend through the opening of the clamp and through a hole in the overhead door; and disposing a spring element around a body of the fastener, the spring element residing between an inner surface of the overhead door and the second surface of the clamp;

wherein, an end of the fastener accepts a coupling element, the coupling element being turned in a direction to compress the spring element, which biases the clamp in a direction away from the overhead door, and maintains the portable barricade in a position physically touching an interior side of the overhead door.

9. The method of claim 8, further comprising providing an anchor to receive the fastener within the hole of the overhead door.

10. The method of claim 8, further comprising providing an elastic element located on the second surface of the clamp.

11. The method of claim 8, wherein the fastener is a threaded carriage bolt.

12. The method of claim 8, wherein, when the coupling member is turned in a reverse direction, a distance between the clamp and the overhead door is increased to release the portable barricade located behind the clamp from secure engagement with the overhead door.

13. The method of claim 8, further comprising providing a base plate configured to operably engage the overhead door to accommodate a weight of the portable barricade.

14. An attachment assembly, comprising:

a clamp, the clamp having a first surface and a second surface, the second surface facing an overhead door;

a fastener passing through a clamp opening of the clamp and engaging the overhead door;

a coupling member operably engaged with the fastener;

a biasing element positioned between the second surface of the clamp and the overhead door;

wherein, an end of the fastener accepts the coupling element, the coupling element being turned in a direction to compress the biasing element, which biases the clamp in a direction away from the overhead door, and maintains a portable barricade in a position physically touching an interior side of the overhead door.

15. The attachment assembly of claim 14, further comprising an anchor to receive the fastener within an opening of the overhead door.

16. The attachment assembly of claim 14, further comprising an elastic element located on the second surface of the clamp.

17. The attachment assembly of claim 14, wherein the portion of the portable barricade is urged toward the overhead door to secure the portable barricade against an inner surface of the overhead door.

18. The attachment assembly of claim 14, wherein the fastener is a threaded carriage bolt.

19. The attachment assembly of claim 14, wherein, when the coupling member is actuated in a second direction, a distance between the clamp and the overhead door is increased to release the portable barricade located behind the clamp from secure engagement with the overhead door.

20. The attachment assembly of claim 14, further comprising a base plate configured to operably engage the overhead door to accommodate a weight of the portable barricade.

* * * * *